US005549210A

United States Patent [19]

Cheng

[11] Patent Number: 5,549,210

[45] Date of Patent: Aug. 27, 1996

[54] WIDE STANCE FOOTED BOTTLE WITH RADIALLY NON-UNIFORM CIRCUMFERENCE FOOTPRINT

[75] Inventor: Jizu J. Cheng, Franklin Park, N.J.

[73] Assignee: Brunswick Container Corporation, East Brunswick, N.J.

[21] Appl. No.: 166,340

[22] Filed: Dec. 13, 1993

[51] Int. Cl.[6] ..... B65D 1/02; B65D 23/00

[52] U.S. Cl. ..... 215/375; 215/377; 220/606

[58] Field of Search ..... 215/1 C, 100 R, 215/379, 375; 220/606, 608

[56] References Cited

U.S. PATENT DOCUMENTS

| | | | |
|---|---|---|---|
| D. 240,019 | 5/1976 | Taylor | 220/606 X |
| 3,403,804 | 10/1968 | Columbo | 215/31 |
| 3,511,401 | 5/1970 | Lachner | 215/1 C |
| 3,598,270 | 8/1971 | Adomatis | 215/1 C |
| 3,727,783 | 4/1973 | Carmichael | 215/1 C |
| 3,871,541 | 3/1975 | Adomatis | 215/1 C |
| 3,935,955 | 2/1976 | Das | 215/1 C |
| 4,247,012 | 1/1981 | Alberghini | 215/1 C |
| 4,249,667 | 2/1981 | Pocock et al. | 215/1 C |
| 4,254,882 | 3/1981 | Yoshino | 215/1 C |
| 4,294,366 | 10/1981 | Chang | 215/1 C |
| 4,318,489 | 3/1982 | Snyder et al. | 220/606 X |
| 4,334,627 | 6/1982 | Krishnakumar et al. | 215/1 C |
| 4,335,821 | 6/1982 | Collette et al. | 215/1 C |
| 4,355,728 | 10/1982 | Yoshino et al. | 220/606 X |
| 4,785,949 | 11/1988 | Krishnakumar et al. | 215/1 C |
| 4,785,950 | 11/1988 | Miller et al. | 215/1 C |
| 4,865,206 | 9/1989 | Behm et al. | 220/606 X |
| 4,867,323 | 9/1989 | Powers | 215/1 C |
| 4,892,205 | 1/1990 | Powers et al. | 215/1 C |
| 4,978,015 | 12/1990 | Walker | 215/1 C |
| 5,024,339 | 6/1991 | Riemer | 215/1 C |
| 5,024,340 | 6/1991 | Alberghini et al. | 215/1 C |
| 5,066,081 | 11/1991 | Bartley et al. | 215/1 C |
| 5,080,244 | 1/1992 | Yoshino | 220/606 X |
| 5,139,162 | 8/1992 | Young et al. | 220/606 X |
| 5,160,059 | 11/1992 | Collette et al. | 215/1 C |

FOREIGN PATENT DOCUMENTS

| | | | |
|---|---|---|---|
| 0225155 | 6/1987 | European Pat. Off. . | |
| 4044943 | 2/1992 | Japan | 215/1 C |
| 4-189739 | 7/1992 | Japan | 215/1 C |
| 2067160 | 7/1981 | United Kingdom | 215/1 C |
| 9200880 | 1/1992 | WIPO | 215/100 R |

*Primary Examiner*—Sue A. Weaver
*Attorney, Agent, or Firm*—Robert F. Zielinski

[57] ABSTRACT

Hollow plastic blow-molded containers have a tubular bodies and integral improved, self-supporting bases. The bases have distinctly shaped supporting feet disposed on legs at or near the periphery of the container bottom. The container legs extend outwardly and downwardly from the central region of the container on the inner side of the container bottom and extend downwardly from the container sidewalls on the outer side and are separated by ribs which coverage in a central region at the base of the container. At the terminal end of each of the container legs, there are horizontal contact surfaces or feet which are defined by foot edges which include an inner foot edge portion and an outer foot edge portion, the outer foot edge portion includes a pair of outer far corner foot edges and a far middle foot edge portion. The far middle foot edge portion extends radially to a point further than the outer far corner foot edges. The differences between the middle and far outer corner foot edge radii give rise to a container footprint which is essentially non-uniform with the circumference of the container. The unique, non-uniform footprint provides manufacturing advantages in terms of an expanded processing window which is well-suited to a high speed manufacturing environment.

16 Claims, 5 Drawing Sheets

WIDE STANCE FOOTED BOTTLE WITH RADIALLY NON-UNIFORM CIRCUMFERENCE FOOTPRINT

FIELD OF THE INVENTION

The present invention relates to hollow plastic containers and, more specifically, to blow-molded plastic containers which are used for liquids under pressure and which have improved, self-supporting bases. The bases have distinctly shaped supporting feet disposed near the periphery of the container bottom. The supporting feet are defined on one side by an outer foot edge, the middle portion of which extends radially to a point further than the far outer corner foot edge corners. The differences between the middle and far outer corner foot edge radii give rise to a container footprint which is essentially non-uniform with the circumference of the container. The unique, non-uniform footprint provides manufacturing advantages in terms of an expanded processing window and is well-suited to a high speed manufacturing environment. Additionally, the container of the present invention may be manufactured with less plastic material than has been required by known prior art bottles, yet the container has sufficient strength to withstand internal pressures like those typically encountered in the packaging and handling of carbonated beverages and the like.

BACKGROUND OF THE INVENTION

Blow-molded plastic containers for containing liquids at elevated pressures are known and have found increasing acceptance in the beverage industry. Such containers have particular advantages in that they have considerably less weight than glass containers, are generally less subject to breaking during handling and transportation and may be relatively easily manufactured. Moreover, the materials used in their manufacture may also be recycled after use. In general, these types of containers are most convenient for use as one way disposable containers.

Although such containers are particularly well suited for use in the beverage industry, plastic bottles of this type are subject to a number of structural and functional criteria which have presented many problems which have not been adequately solved. Solutions to the problems offered by the prior art have yielded bottles which are still not entirely satisfactory.

Several types of containers exist in the known art which include integral bases with molded bottom configurations. Examples of these types of containers are found in U.S. Pat. No. 3,403,804 to Columbo entitled "Blow Molded Bottle of Flexible Plastic"; U.S. Pat. No. 4,249,667 to Pocock, et. al. entitled "Plastic Container with a Generally Hemispherical Bottom Wall having Hollow Legs Projecting Therefrom"; U.S. Pat. No. 3,935,955 to Das entitled "Container Bottom Structure"; U.S. Pat. No. 4,108,324 to Krishnakumar, et. at. entitled "Ribbed Bottom Structure for Plastic Container"; U.S. Pat. No. 3,871,541 to Adomaitis entitled "Bottom Structure for Plastic Containers"; U.S. Pat. No. 3,598,270 to Adomaitis, et. at. entitled "Bottom End Structure for Plastic Containers"; U.S. Pat. No. 5,024,340 to Alberghini, et. at., entitled "Wide Stance Footed Bottle"; U.S. Pat. No. 4,867,323 to Powers, entitled "Blow-molded Bottle with Improved Self-Supporting Base" and U.S. Pat. No. 4,978,015 to Walker, entitled "Plastic Container for Pressurized Fluids". While there are structural differences in the containers disclosed by these patents, they all share a common feature in that these containers have feet with contact surface edges which are essentially of a uniform radius with respect to the bottle circumference. These containers are generally acceptable; however, they are still susceptible to stress cracking and there still exists a need for a container of this type which may be manufactured with a minimal amount of material in the base; is capable of withstanding internal pressures; is resistant to stress cracking; will stand upright without rocking and which can be manufactured in a high-speed bottle manufacturing environment.

In existing one piece bottle bottom construction, three general problems have been identified in the art. Initially, such plastic bottles have not had enough bottom strength to withstand the impact of falling from moderate height on to a hard surface when filled with a carbonated beverage. Further, because the bottles are often subjected to extreme temperatures, it has been found in some designs that the bottom of the bottle inverts or otherwise distorts producing a bottle known in the industry as "rocker" where the bottle wobbles in transportation or display and is otherwise unstable. Finally, another problem is the stress cracking of such bottles, especially under extremes of temperature or pressure or when exposed to any stress cracking agent during filling, handling or subsequent transportation. The problems with these types of bottles are due to design limitations and to material characteristics and flaws which are often exaggerated in a high speed bottle manufacturing environment, particularly where the plastic preform may be improperly heated, insufficiently stretched, inadequately oriented and/or a combination of these defects. Simply stated, these bottles are often incorrectly blown.

PET is a plastic polymer material with a combination of properties which are particularly desirable for the packaging of carbonated beverages. These properties include flexibility, toughness, clarity, creep resistance, strength, and high gas barrier. Furthermore, because PET is thermoplastic, it can be recycled by the application of heat and is therefore environmentally attractive.

The processing of the container of the present invention involves the injection molding of PET into what is commonly referred to as a "preform" and blow-molding the preform into the container. In such a process, biaxial orientation is introduced into the PET by producing stretch along both the length of the bottle and the circumference of the bottle. In stretch blow molding, a stretch rod is utilized to elongate the preform and air or other gas is blown into the preform and radially stretches the preform, both of which happen essentially simultaneously. Prior to blow-molding, the preforms are preheated to the correct temperature, generally about 100° C., but this varies depending on the particular PET or other plastic material being used.

In the various known processes for manufacturing plastic blow-molded PET bottles, there are certain parameters which must be carefully controlled in order to produce commercially acceptable containers on a reliable basis. These process parameters are generally referred to as the "process window" and include, in addition to the temperature (i.e. heating and cooling), dwell time in the mold, stretch force of the rod and the pressure of the air or other gas blown into the container. Of those parameters, the temperature and dwell time in the mold, generally referred to as the temperature profile, are often thought to be most critical, particularly, in containers with integral self-supporting bases. In manufacturing these bottles in a high speed manufacturing environment, slight variations, minor modifications or aberrant fluctuations in any one of these parameters often leads to unacceptable results. In these situations the process window is said to be narrow in that there is little, if any, tolerance for even the slightest change in these parameters.

For example, it is known in the art that temperature and temperature profile of heating the preform is important to achieve the intended distribution of material over the bottom wall during forming. It is also well known in the art how to alter such a temperature profile to produce an acceptable bottle once the design of the mold is known. Once the PET preform is in the desired temperature it is secured by its neck in a mold which has a cavity of the desired bottle shape. A stretch rod is introduced into the mouth of the bottle to distribute the material the length of the bottle and to orient the molecules of PET longitudinally. Simultaneously, air is blown into the bottle from around the stretch rod to distribute the material radially to give the radial or hoop orientation of the PET.

As the newly formed bottle expands, the exterior surface of the bottle comes into contact the mold interior surfaces which are cooled to a temperature which may be substantially less than the preheat temperature of the mold, via water-cooling or other similar means. Contact of the heated and stretched plastic with the cooler mold surfaces causes the biaxially oriented PET to rapidly cool. Preferably, it is desirable to have the bottle walls contact all the mold surfaces nearly simultaneously, in order that the cooling is uniform. After sufficient cooling has taken place, the mold is opened and the finished bottle is removed.

During blow-molding, the preform plastic first contacts the apex and rib portions of the mold and then stretches into the feet and to the bearing surfaces. As a result, the plastic cools in the apex and rib area and reduces the stretchability of the plastic. The effect of this non-uniform cooling is a greater wall thickness in the apex and ribs which, in turn, requires an increase in dwell time in the mold in order to stretch the plastic sufficiently to reach the outermost edge portions of the bearing surfaces.

It is well recognized that the utility of plastics, in general, and specifically of PET as a material for blow-molded containers is dependent upon the form in which it exists in a solid state. For example, solid PET exists in three basic forms: amorphous, crystalline, and biaxially oriented. Each form has characteristics which make it suitable for use either in the preform or in the blown bottle, but rarely in both.

PET in the amorphous state is formed when molten PET is rapidly cooled to below approximately 80° C. It appears clear and colorless and is only moderately strong and tough. This is the state that preforms are in prior to being injection molded. Crystalline PET is formed when the molten PET is cooled slowly to below 80° C. In the crystalline state, PET appears opaque, milky-white and is brittle. Crystalline PET is stronger than amorphous PET and because it is strong, badly formed bottles will result from the blow molding process if significant amounts of crystalline PET are present in the preform.

Oriented PET is formed by mechanically stretching amorphous PET at above 80° C. and then cooling the material. Biaxially oriented PET is usually very strong, clear, tough and has good gas barrier properties. It is generally desirable in order to obtain sufficient biaxial orientation that the amount of stretch being applied to the amorphous PET be on the order of at least 3 to 1.

Finally, while biaxially oriented PET is exceptionally clear and resistant to stress cracking, non-biaxially oriented, crystalline PET is neither clear nor resistant to stress cracking. Further, amorphous PET, although clear is not resistant to stress cracking. Thus, it will be appreciated that in the design and processing of blow-molded plastic containers made of PET, it is desirable to minimize or eliminate the presence of any crystalline PET material in a preform as well as to obtain the maximum biaxial orientation possible in the blown bottle.

Blow-molded bottles formed from injection molded preforms tend to have a particularly acute stress cracking problem in two areas. The first problem area is the bottom portion of the bottle which includes and lies adjacent to the nib remaining on the preform from the sprue or "gate" through which the molten polymer is injected into the preform mold. This gate area is manifested in the blow-molded bottle by a clouded circlet at or very near the center of the bottle bottom. In prior art bottles, this gate area contains far less biaxial orientation than is present in the bottle sidewall or in the remainder of the bottom. As a result of this deficiency, the gate area of a bottle blow-molded from an injection molded preform is more apt to fail under stress than other areas of the bottle sidewall or bottom. The second problem areas which are susceptible to stress cracking are found at or near the transition surfaces between the bottle ribs and where the contact surfaces intersect with the container sidewalls. Stress cracking typically occurs in these areas because of improper distribution of plastic materials, or from insufficient stretch and orientation, or both. Often these problems are due to errors which occur during the processing of such containers, particularly in a high speed bottle manufacturing environment where the process window may be narrow because of the critical relationship between the manufacturing parameters. These errors cause the plastic molded materials to be structurally weak in specific areas which when coupled with the high internal pressures of a filled container and bending moment of the plastic, frequently lead to bottle failure. Stress cracking can occur due to a combination of these problems and is exacerbated particularly under the extreme conditions experienced in the transportation and storage of pressurized containers and especially in geographical areas where ambient temperatures can exceed 100° F.

From the foregoing problems inherent in known prior art bottle designs and manufacturing, it can be seen that it would be desirable to provide a bottle design which may be made with maximum stretch and orientation and minimum thickness in the bottom portion. It will also be appreciated that it would be desirable to provide a bottle which has a shorter process time and simultaneously, a larger process window particularly suited to a high speed bottle manufacturing environment. Finally, it also be appreciated that it would be desirable to provide a bottle which uses less plastic materials but is more resistant to stress cracking than known prior art bottles.

Accordingly, it is an object of this invention to provide a plastic bottle in which the manufacturing process window is enlarged.

It is another object of this invention to provide a plastic bottle in which the plastic material is distributed in a more uniform manner throughout the bottle and particularly in the bottom portion.

Still another object of this invention is to provide a bottle with better standing capability.

Yet another object of this invention is to provide a bottle having improved stability, improved resistance to stress cracking as well as providing a bottle with a reduced weight resulting in a cost saving of material used.

From the subsequent description and claims taken in conjunction with the accompanying drawings, other objects and the advantages of the present invention will become apparent to those skilled in the art.

SUMMARY OF THE INVENTION

The present invention provides the art with a container having a tubular body and an integral base, the junction of the two having an essentially smooth, continuous exterior surface. The container bottom is generally of a frusto-conical shape. The container legs are separated by ribs which converge in a central region at the base of the container. At one end of each of the container legs, there are contact surfaces or feet which are defined by foot edges. The foot edges extend outwardly and downwardly from the central region of the container on the inner side of the container bottom and extend downwardly from the container sidewalls on the outer side. The contact surfaces of each foot include at least an inner foot edge, a pair of outer far corner foot edges and a far middle foot edge. Although the feet are situated in a generally circular formation with respect to the container axis, the outer foot edges are non-uniform with respect to that axis.

The present invention provides a container with good distribution of plastic throughout the container surface and, in particular, at the container base. Also, the present invention eliminates stress cracks, enables the use of a minimal amount of plastic material to mold the container and effectively enlarges the process window by reducing both the amount and the distance that the molded plastic must expand for maximum orientation. Additionally, when the container is full of a carbonated beverage or the like, the container will withstand the pressure necessary to maintain carbonation and will exhibit a very sturdy and rigid outer body strength. Once the beverage has been removed from the container, the container is very flexible and enables the container to be discarded and the plastic to be recycled. Accordingly, the present invention provides an improved blow-molded plastic container having the above advantages.

DETAILED DESCRIPTIONS OF PREFERRED EMBODIMENTS

Figure 1:
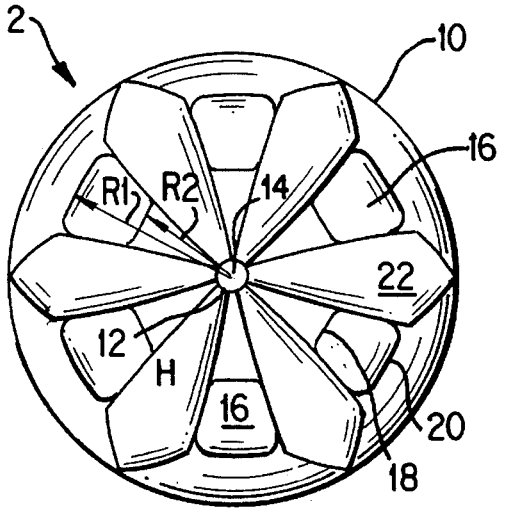
FIG. 1 PRIOR ART
FIG. 1 is a bottom plan view of the bottom portion of a prior art bottle.
Figure 2:
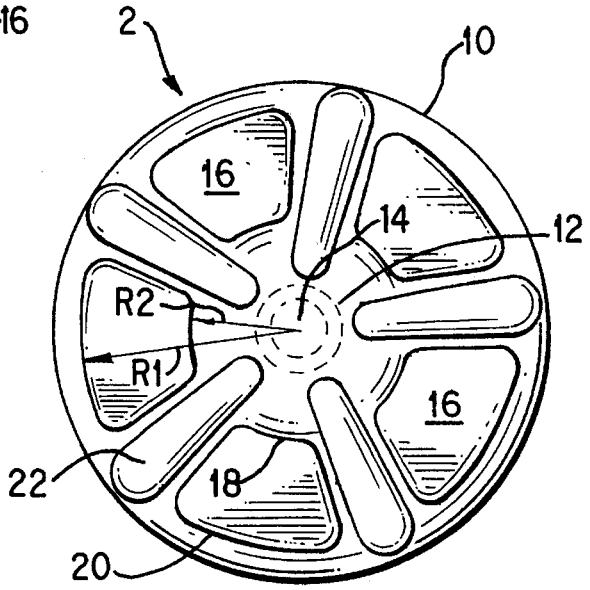
FIG. 2 PRIOR ART
FIG. 2 is a bottom plan view of a bottom portion of another prior art bottle.
Figure 3:
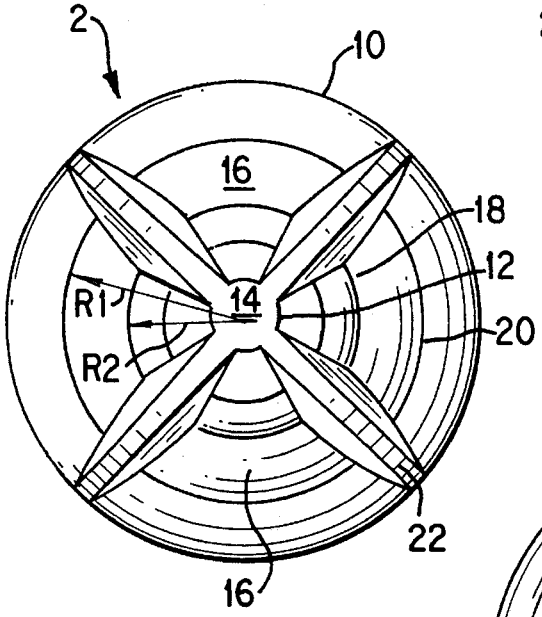
FIG. 3 PRIOR ART
FIG. 3 is a bottom plan view of the bottom portion of still another prior art bottle.
Figure 4:
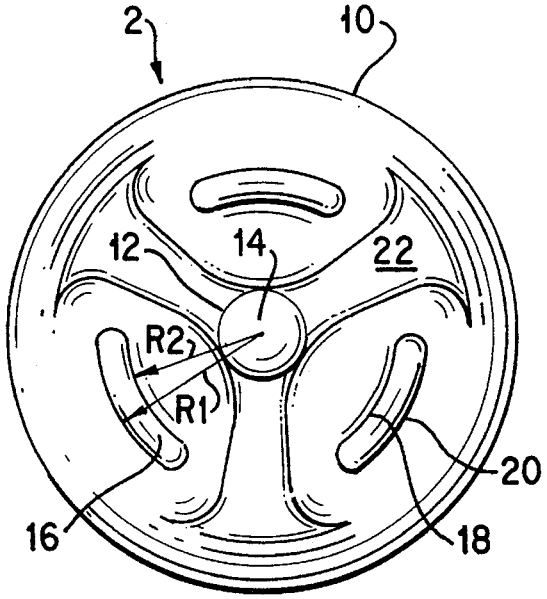
FIG. 4 PRIOR ART
FIG. 4 is a bottom plan view of the bottom portion of yet another prior art bottle.

In the container of the present invention, the container legs and feet form the generally frusto-conically shaped container bottom. The container legs are separated and defined by a plurality of ribs which depend from the container wall and coverage in a central region at the base of the container. In planar cross-section, the bottom wall of the container is generally hemispherical as measured from the path of the ribs. The central region of the container also has an upwardly convexed domed surface region from which the contact surfaces of each foot of the base downwardly extend. The contact surface of the container feet are defined by foot edges which extend outwardly and downwardly from the central region of the container on the inner side and which extend downwardly from the container sidewalls on the outer side. Specifically, the contact surfaces of each foot are defined by an inner foot edge, a pair of outer far corner foot edges and a far middle foot edge. The outer far corner foot edges are characterized by its non-uniform radius with respect to the far middle foot edge. The far middle foot edge is characterized by its generally uniform radius with respect to curvature of the container. As used herein, non-uniform radius means that the foot edge is not of a constant or fixed dimension as measured by its radius. As a result, instead of the typical uniformly circumferential footprint found in the prior art, the bearing surfaces of containers of the present invention are generally somewhat elliptical or crescent shaped.

In one preferred configuration, the inner foot edge is of a fixed radius and the outer foot edge is of a varying radius, with the outer far corner foot edges extending in a radial direction substantially less than the far middle foot edge. Typically, for example, the far corner foot edges provide contact radii of only approximately 35% to 65% of the bottle radius, with the far middle foot edge providing a maximum contact radius of approximately 80% of the bottle radius. In other preferred embodiments, the near middle inner foot edge has a variable radius and may extend inwardly, towards the central region and is thusly, also non-uniform with respect to the curvature of the container.

In accordance with this invention, it is proposed to modify the edge portions of the feet on which the bottle rests to include such a non-uniform bottom circumferential footprint. Because the shape of the feet also affects the distribution and strength of the plastic material of the container, the effect of non-uniform foot edges is a better balance of the tension of the surface areas between the foot edges and the lower portions of the container sidewalls with the bending moment of the plastic material. It has been found that by making this modification in the bottom configuration the advantages of both proper biaxial orientation and stretch are maximized.

Although polyethylene terephthalate (PET) is a preferred plastic used in the formation of bottles for carbonated beverages, other resins can be satisfactorily employed. These include, for example, other saturated polyesters, polyvinylchloride, nylon and polypropylene. PET is a particularly desirable material to use in such bottles because, when properly processed, it has the requisite clarity, strength and resistance to pressure leakage necessary for such bottles. Specifically, when properly blow-molded PET is essentially transparent. Additionally, the PET material has sufficient gas barrier properties so that carbonated beverages can be stored for extended periods of time without losing any significant amounts of the $CO^2$ pressure given by carbonation. Commonly, these containers are blow-molded from injection molded "preforms" of PET.

In FIGS. 1 through 4, there are shown plan views of examples of known prior art bottle bottom configurations. Bottoms 2 are generally defined by one terminal end of a tubular body sidewall 10 on which the bottoms are disposed. Located centrally within the bottle bottoms are central regions 12 each having a radius center point 14 which corresponds to the longitudinal axis of the bottle. Disposed circumferentially about the bottle bottom are horizontal contact surfaces or feet 16, each of which has an inner foot edge 18 and an outer foot edge 20. Disposed between and further defining the feet of the bottles are a plurality of ribs 22 of varying thickness and cross-section which generally converge in or about a central region of the bottle bottom. The inner foot edges 18 and outer foot edges 20 are generally defined by a uniform or fixed radii as measured from center points 14. The outer foot edges are generally defined by R1 with the inner foot edges being generally defined by R2 as measured from radius center points 14. As can be seen from the foregoing prior art, although the bottle bottom configurations vary, the radial arc which defines both the inner and outer foot edges respectively are essentially uniform with respect to the circumferential footprint of the bottle.

Figure 5:
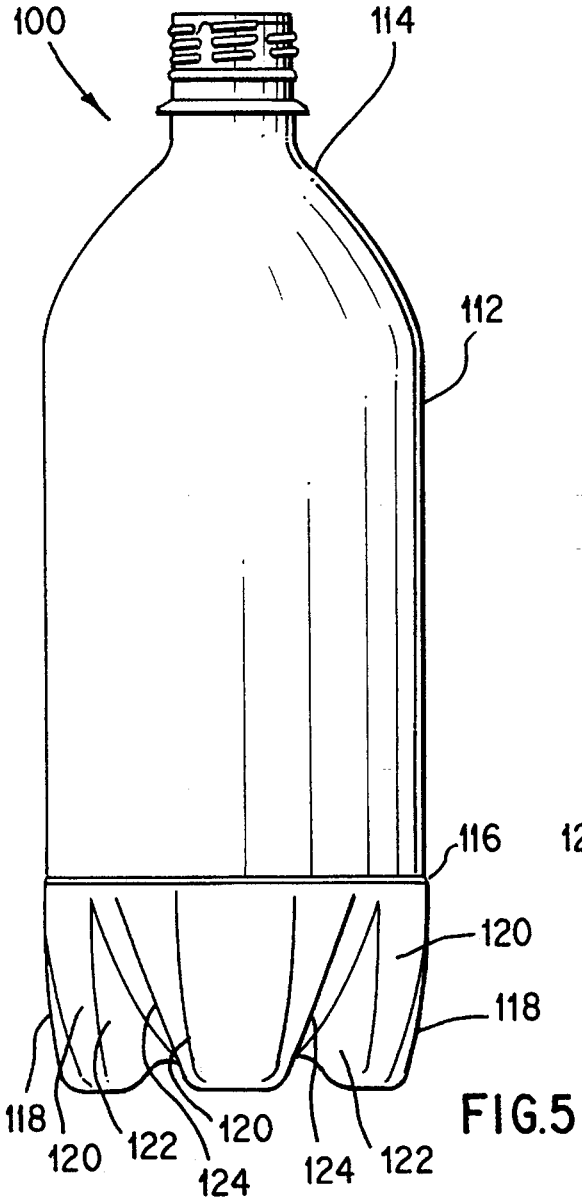
FIG. 5 is a side elevational view of a container in accordance with the present invention.

Referring now to FIG. 5, there is shown a side view of a container in the form of a bottle 100. Bottle 100 is constructed having a body which comprises a generally cylindrical sidewall portion 112, a neck portion 114 and a bottom portion 116. The upper neck portion 114 can have any desired neck finish such as the threaded finish which is shown, and is generally closable to form a pressurized bottle. A bottom portion 116 is provided at the lower end of the sidewall portion 112. Bottom portion 116 is generally of a frusto-conical shape and includes a plurality of hollow legs 118. Alternating between the plurality of legs 118 are ribs 124. In planar cross-section, the bottom wall of the container is essentially hemispherical as measured from the path of the fibs, although it will be appreciated the path followed by the ribs may also be somewhat elliptical. On the outer sidewall of legs 118 are outer sidewall segments 120 and inner sidewall segments 122. The inner and outer sidewall segments together form a transition surface which extends upwardly from the contact surfaces of the container (not shown) and outwardly to the ribs. Outer sidewall segment 120 lies adjacent the circumferential surface of legs 118 while inner sidewall segment 122 lies directly adjacent ribs 124. As can be best seen with reference to FIGS. 6, 7 and 8, ribs 124 are continuous and extend downwardly from the container sidewalls to central region 126 which is upwardly convexed.

Figure 6:
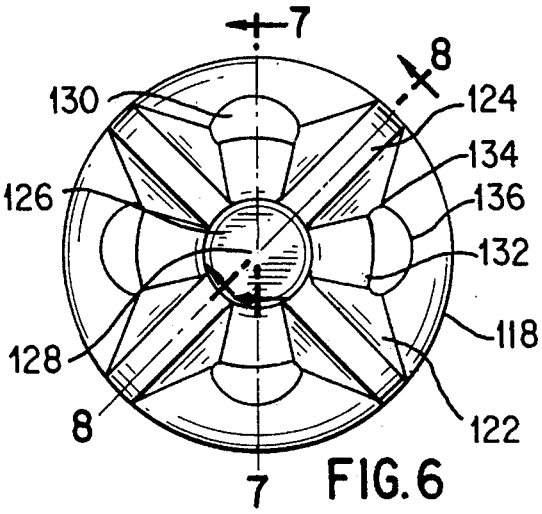
FIG. 6 is a bottom plan view of the container in FIG. 5.

Referring specifically to FIG. 6, there is shown a bottom plan view of an embodiment of the present invention where there are four feet 130 separated by four corresponding ribs 124. Hollow container legs 118 extend outwardly and downwardly from central region 126 of the container on the inner side of container bottom 116 and extend downwardly from the container sidewalls on the outer side. Positioned centrally within central region 126 is radius center point 128. Legs 118 terminate in feet 130 which are defined by foot edges which include an inner foot edge portion 132 and an outer foot edge portion. The outer foot edge portion includes a pair of outer far corner foot edges 134 and a far middle foot edge 136. In the embodiment shown, outer far corner foot edges 134 provide contact radii of approximately 35 to 65% of the bottle radius, with far middle foot edge 136 providing a maximum contact radius of approximately 70 to 85% of the bottle radius. Preferably, outer far corner foot edges 134 provide contact radii of 40 to 60% of the bottle radius, with far middle foot edge 136 providing a maximum contact radius of approximately 80% of the bottle radius. As is shown more clearly in FIG. 9, far middle foot edge 136 extends radially to a point further than outer far corner foot edges 134. The differences between the far middle and far outer corner foot edge radii give rise to a container footprint which is essentially non-uniform with the circumference of the container.

Figure 10:
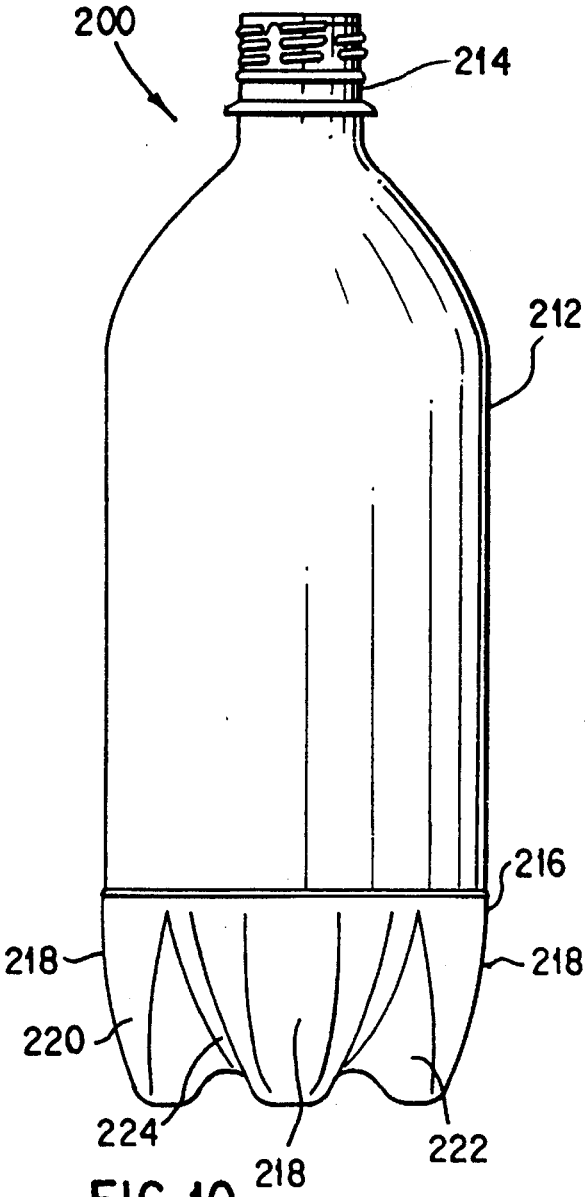
FIG. 10 is a side elevational view of an alternate form of the container of the present invention.
Figure 11:
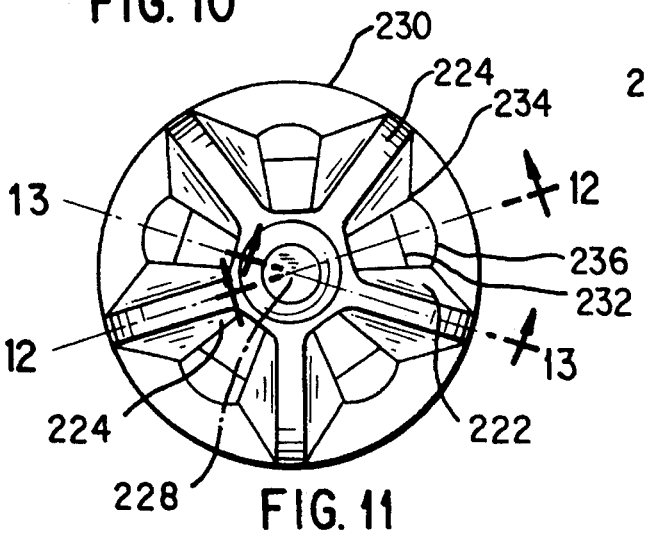
FIG. 11 is a bottom plan view of the container shown in FIG. 10.

It will be appreciated that the bottom section 116 can be comprised of four feet 130 as shown in FIGS. 5–6 and FIGS. 14–15, or as shown in FIGS. 10–11, the bottom section can be comprised of five feet. It is also understood that the embodiments herein described and shown in the drawings are preferred embodiments only and that the number of feet, although primarily a function of aesthetics, is also subject to certain mechanical considerations and limitations. However, it is also understood that it may be preferable to use a large number of feet in a larger bottle to provide more ribs which provide both increased stability and rigidity in the bottom section. Moreover, the number of feet used must be sufficient so that the structure of the feet as herein described is able to cause the PET material within the contact surface areas to be sufficiently stretched so as to cause biaxial orientation.

Figure 7:
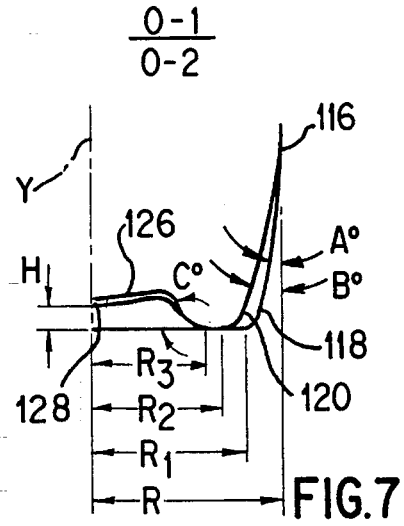
FIG. 7 is a partial sectional view of a portion of the container from the central axis to the container sidewall seen from substantially the line 7—7 in FIG. 6.

Referring now to FIG. 7, there is shown a sectional of the bottom wall side portion of the bottle bottom shown in FIG. 6 along the line 7—7. It will be seen that the cylindrical sidewall 116 is generally symmetric about a longitudinal axis Y of the bottle 100. The tubular bottle body wall 116 extends outwardly and radially from the longitudinal axis of the bottle to a distance generally represented by R, the container radius. Container leg 118 depends downwardly from sidewall 116 and is formed inwardly about at an angle of "A" approximately 7° to 13° off of vertical. The lower portion of leg 118 intersects with the horizontal contact surface comprising the foot and forms the outer far middle foot edge, generally represented by R1. R1 may be approximately from 70 to 0.85 R. Also depending downwardly from sidewall 116 and adjacent leg 118 is outer sidewall segment 120. Outer sidewall segment 120 depends downwardly at an angle of "B" which is from 1.7 to 2.1 times the angle of "A" and which intersects the horizontal contact surface at the outer far corner foot edge, generally represented by R2. R2 may be approximately from 0.35 to 0.65 R. The inner edge of the contact surface is generally defined by R3 which may be from 0.20 to 0.50 R and angle "C" which forms the inner sidewall of the upwardly convexed central region 126. Angle "C" is preferably from 1.0 to 1.8 times the sum of angle "A" plus angle "B". The height of the upwardly convexed central region, represented by "H" is approximately from 0.90 to 1.3 times the distance R2 minus the distance R3.

Figure 8:
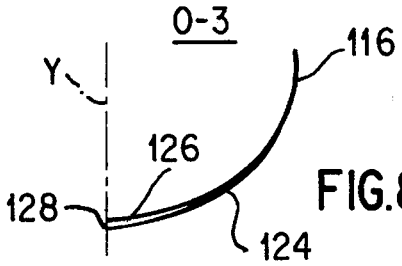
FIG. 8 is a partial sectional view of a portion of the container from the central axis to the container sidewall seen from substantially the line 8—8 in FIG. 6.

In FIG. 8 there is shown a sectional view of FIG. 6, from the line 8—8. The generally hemispherical path of ribs 124 is shown extending downwardly from sidewall 116 and converging centrally to the bottle axis Y. It will also be appreciated that ribs 124 may follow paths of other shapes such as those which may be less than hemispherical to partially elliptical.

Figure 9:
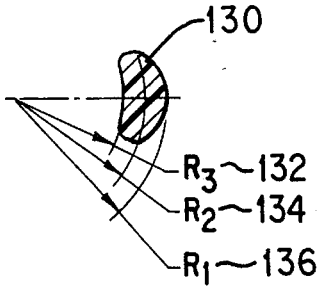
FIG. 9 is a detailed view of the contact surface foot of the container shown in FIG. 6.

In FIG. 9, there is shown a detailed view of the contact surface or foot 130 of the container shown in FIG. 6. Feet 130 are defined by foot edges that include an inner foot edge portion 132, and an outer foot edge portion. Inner foot edge portion is defined substantially by the distance R3, roughly from 25 to 50% of the bottle radius. The outer foot edge portion includes a pair of outer far corner foot edges 134 and a far middle foot edge 136. Outer far corner foot edges 134 are substantially defined by R2 and provide contact radii of roughly 35 to 65% of the bottle radius. R2 also represents approximately the radial mid-point of foot 130. Far middle foot edge 136 is substantially defined by R1 and provides a maximum contact radius of approximately 70 to 85% of the bottle radius.

Reference is now made to FIGS. 10 through 13, wherein the structures generally described above have corresponding structures which are identified beginning with the number 200 and proceeding from that number. It will be seen that the overall bottle configuration is essentially similar to those described in FIGS. 5 through 8, with the exception that bottle 200 has five feet.

Referring now to FIG. 10, there is shown a side view of a container in the form of a bottle 200. Bottle 200 is constructed having a body which comprises a generally cylindrical sidewall portion 212, a neck portion 214 and a bottom portion 216. The upper neck portion 214 can have any desired neck finish such as the threaded finish which is shown, and is generally closable to form a pressurized bottle. A bottom portion 216 is provided at the lower end of the sidewall portion 212. Bottom portion 216 is generally of a frusto-conical shape and includes a plurality of hollow legs 218. Alternating between the plurality of legs 218 are ribs 224. On the outer sidewall of legs 218 are outer sidewall segments 220 and inner sidewall segments 222. The inner and outer sidewall segments together form a transition surface which extends upwardly from the contact surfaces of the container (not shown) and outwardly to the ribs. Outer sidewall segment 220 lies adjacent the circumferential surface of legs 218 while inner sidewall segment 222 lies directly adjacent ribs 224. As can be best seen with reference to FIGS. 11, 12 and 13, ribs 224 are continuous and extend downwardly from the container sidewalls to central region 226 which is upwardly convexed.

Referring specifically to FIG. 11, there is shown a bottom plan view of an embodiment of the present invention where there are five feet 230 separated by five corresponding ribs 224. Hollow container legs 218 extend outwardly and downwardly from central region 226 of the container on the inner side of container bottom 216 and extend downwardly from the container sidewalls on the outer side. Positioned centrally within central region 226 is radius center point 228. Legs 218 terminate in feet 230 which are defined by foot edges which include an inner foot edge portion 232 and an outer foot edge portion. The outer foot edge portion includes a pair of outer far corner foot edges 234 and a far middle foot edge 236. In the embodiment shown, outer far corner foot edges 234 provide contact radii of approximately 35 to 65% of the bottle radius, with far middle foot edge 236 providing a maximum contact radius of approximately 70 to 85% of the bottle radius. Preferably, outer far corner foot edges 234 provide contact radii of 40 to 60% of the bottle radius, with far middle foot edge 236 providing a maximum contact radius of approximately 80% of the bottle radius.

Figure 12:
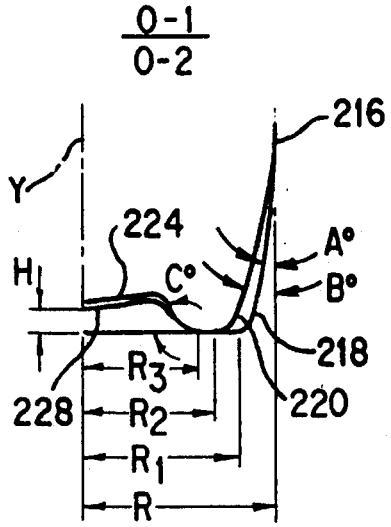
FIG. 12 is a partial sectional view of a portion of the container from the central axis to the container sidewall seen from substantially the line 12—12 in FIG. 11.

Referring now to FIG. 12, there is shown a sectional of the bottom wall side portion of the bottle bottom shown in FIG. 11 along the line 12—12. It will be seen that the cylindrical sidewall 216 is generally symmetric about a longitudinal axis .Y of the bottle 200. The tubular bottle body wall 216 extends outwardly and radially from the longitudinal axis of the bottle to a distance generally represented by R, the container radius. Container leg 218 depends downwardly from sidewall 216 and is formed inwardly about at an angle of "A" approximately 7° to 13° off of vertical. The lower portion of leg 218 intersects with the horizontal contact surface comprising the foot and forms the outer far middle foot edge, generally represented by R1. R1 may be approximately from 0.75 to 0.85 R. Also depending downwardly from sidewall 216 and adjacent leg 218 is outer sidewall segment 220. Outer sidewall segment 220 depends downwardly at an angle of "B" which is 1.7 to 2.1 times twice the angle of "A" and which intersects the horizontal contact surface at the outer far corner foot edge, generally represented by R2. R2 may be approximately from 0.35 to 0.65 R. The inner edge of the contact surface is generally defined by R3 which may be from 0.20 to 0.50 R and angle "C" which forms the inner sidewall of the upwardly convexed central region 226. Angle "C" is preferably from 1.0 to 1.8 times the sum of angle "A" plus angle "B". The height of the upwardly convexed central region, represented by "H" is approximately from 0.90 to 1.3 times the distance R2 minus the distance R3.

Figure 13:
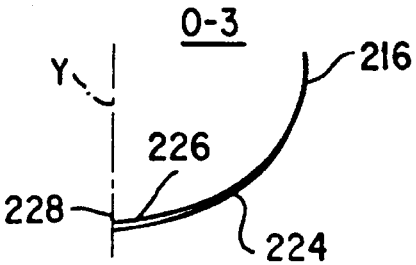
FIG. 13 is a partial sectional view of a portion of the container from the central axis to the container sidewall seen from substantially the line 13—13 in FIG. 11.

In FIG. 13 there is shown a sectional view of FIG. 11, from the line 13—13. The generally hemispherical path of ribs 224 is shown extending downwardly from sidewall 216 and converging centrally to the bottle axis Y. It will also be appreciated that ribs 224 may follow paths of other shapes such as those which may be less than hemispherical to partially elliptical.

Referring now to FIGS. 14 through 18, the structures generally described above have corresponding structures which are identified beginning with the number 300 and proceeding from that number. It will be seen that the overall bottle configuration is essentially similar to that described in FIGS. 5 through 8 and reference is made to those figures with respect to structures and corresponding numbers disclosed in these figures. The embodiment disclosed in FIGS. 14 through 18 differs however in that the inner foot edge is non-uniform with respect to the container circumference.

Figure 14:
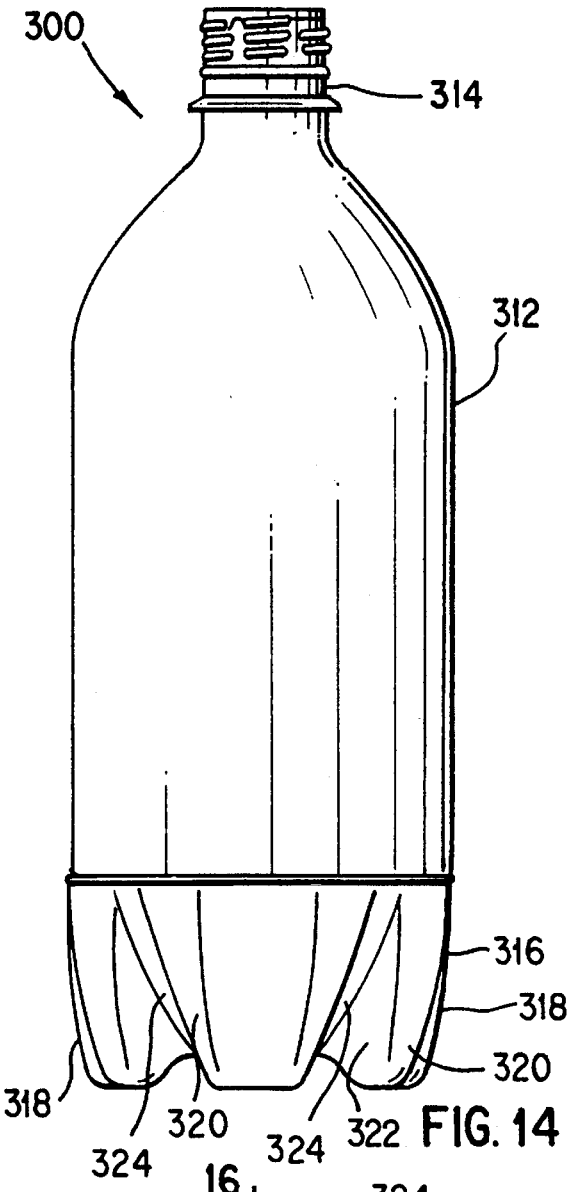
FIG. 14 is a side elevational view of an alternate form of the container of the present invention.

Referring now to FIG. 14, there is shown a side view of a container in the form of a bottle 300 having a cylindrical sidewall portion 312, a neck portion 314 and a bottom portion 316. The neck upper portion 314 can have any desired neck finish, such as the threaded finish which is shown, and is generally closable to form a pressurized bottle. A bottom portion 316 is provided at the lower end of sidewall portion 312. Bottom portion 316 is generally of a frusto-conical shape and includes a plurality of hollow legs 318. Alternating between the plurality of legs 318 are ribs 324. On the outer sidewall of legs 318 are outer sidewall segments 320 and inner sidewall segments 322. The inner and outer sidewall segments together form a transition surface which extends upwardly from the contact surfaces of the container (not shown) and outwardly to the ribs. Outer sidewall segment 320 lies adjacent the circumferential surface of legs 318 adjacent ribs 324. As can best be seen with reference to FIGS. 15, 16 and 17, ribs 324 are continuous and extend downwardly from the container sidewalls to central region 326 which is upwardly convexed.

Figure 15:
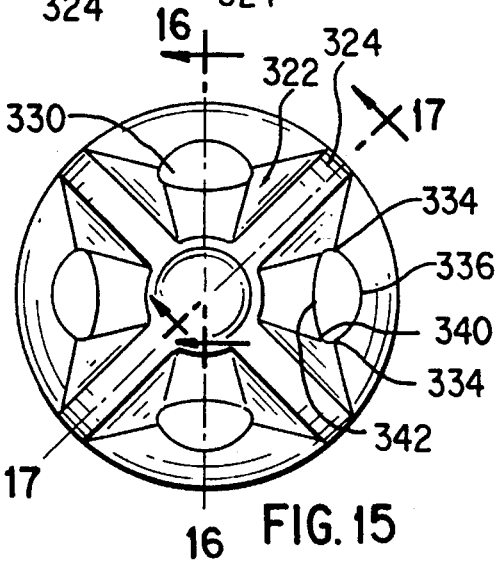
FIG. 15 is a bottom plan view of the container shown in FIG. 14.

Referring specifically to FIG. 15, there is shown a bottom plan view of an embodiment of the present invention where there are four feet 330 separated by four corresponding ribs 324. Hollow container legs 318 extend outwardly and downwardly from central region 326 of the container on the inner side of container bottom 316 and extend downwardly from the container sidewalls on the outer side. Positioned centrally within central region 326 is radius center point 328. Legs 318 terminate in feet 330 which are defined by foot edges which include an inner foot edge portion 332 and an outer foot edge portion. The inner foot edge portion includes a pair of inner near corner foot edges 340 and a near middle foot edge 342. The outer foot edge portion includes a pair of outer far corner foot edges 334 and a far middle foot edge 336. In the embodiment shown, inner near corner foot edges 340 provide contact radii of about 25 to 50% of the bottle radius, near middle foot edge 342 provides a contact radius of about 25 to 30% of the bottle radius, outer far corner foot edges 334 provide contact radii of approximately 35 to 65% of the bottle radius, with far middle foot edge 336 providing a maximum contact radius of approximately 60 to 85% of the bottle radius. Preferably, outer far corner foot edges 334 provide contact radii of 40 to 60% of the bottle radius, with far middle foot edge 336 providing a maximum contact radius of approximately 80% of the bottle radius.

Figure 16:
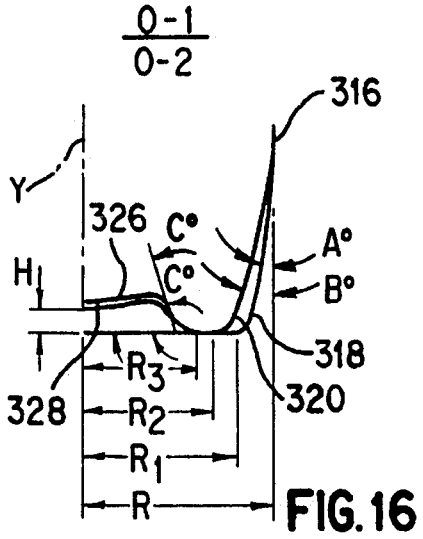
FIG. 16 is a partial sectional view of a portion of the container from the central axis to the container sidewall seen from substantially the line 16—16 in FIG. 14.
Figure 17:
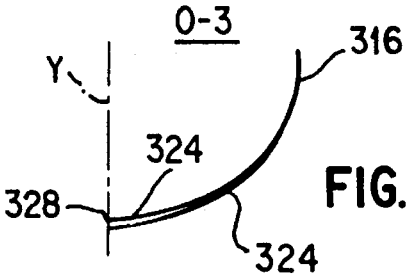
FIG. 17 is a partial sectional view of a portion of the container from the central axis to the container sidewall seen from substantially the line 17—17 in FIG. 14.

Referring now to FIG. 16, there is shown a sectional of the bottom wall side portion of the bottle bottom shown in FIG. 15 along the line 16—16. The tubular bottle body wall 316 extends outwardly and radially from the longitudinal axis of bottle 300 to a distance generally represented by R, the container radius. Container leg 318 depends downwardly from sidewall 316 and is formed inwardly about at an angle of "A" approximately 7° to 13° off of vertical. The lower portion of leg 318 intersects with the horizontal contact surface comprising the foot and forms the outer far middle foot edge, generally represented by R1, whose dimensions are within the ranges specified above. Outer sidewall segment 320 depends downwardly at the angles specified above (roughly 2 times Angle "A") and intersects the horizontal contact surface at the outer far corner foot edge, generally represented by R2. R2 may be approximately from 0.35 to 0.65 R. The inner near corners of the contact surface are generally defined by R3 which may be from 0.20 to 0.50 R. The inner middle foot edge is generally defined by R4 and angle "C" which forms the inner sidewall of the upwardly convexed central region 226. Angle "C" is preferably from 1.0 to 1.8 times the sum of angle "A" plus angle "B". The height of the upwardly convexed central region, represented by "H" is approximately from 0.90 to 1.3 times the distance R2 minus the distance R3.

Figure 18:
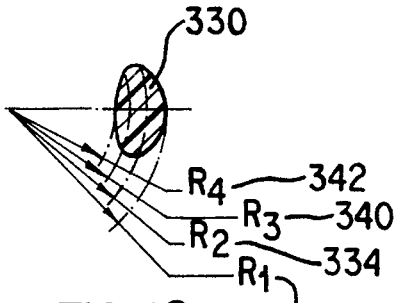
FIG. 18 is a detailed view of the contact surface foot of the container shown in FIG. 14.

In FIG. 18, there is shown a detailed view of the contact surface or foot 330 of the container shown in FIG. 15. Feet 330 are defined by foot edges that include an inner foot edge portion and an outer foot edge portion. Inner foot edge portion includes a pair of inner near corner foot edges 340 and a middle near foot edge 342. Near corner foot edges are defined substantially by the distance R3, roughly from 25 to 50% of the bottle radius. Near middle foot edge is defined substantially by R4, roughly 20% of the bottle radius. The outer foot edge portion includes a pair of outer far corner foot edges 334 and a far middle foot edge 336. Outer far corner foot edges 334 are substantially defined by R2 and provide contact radii of roughly 35 to 65% of the bottle radius. Far middle foot edge 336 is substantially defined by R1 and provides a maximum contact radius of approximately 70 to 85% of the bottle radius.

In the embodiments shown in the foregoing drawings and as described, it will be understood that the relationship of the radius points as reflected by R1, R2, R3 and R4 with the container diameter will remain constant due to the fact that the radius is one half of the diameter. In this regard, for example, where R1 is 0.70 R to 0.85 R, the distance between the points defined by R1—R1 on the bottle bottom will be 70% to 85% of the bottle diameter. Similarly, the distances between corresponding points R2—R2, (since R2 is also expressed as from 0.35 R to 0.65 R), will be a corresponding percentage of the bottle diameter. This relationship may be similarly expressed for R3—R3 and R4—R4, and may also be expressed with respect to the differences in R1—R1 with, for instance, R2—R2 or any other R(n)—R(n) points. For example, where R1—R1 is from 70% to 85% of the bottle diameter, and R2—R2 is from 35% to 65% of the bottle diameter, it will be understood that the difference between R1—R1 and R2—R2 may range from 50% of the bottle diameter at the upper end (where R1 is 0.85 R and R2 is 0.35 R), to 5% of the bottle diameter at the lower end (where R1 is 0.70 R and R2 is 0.65 R).

Likewise, where R1—R1 is from 70% to 85% of the bottle diameter, and R3—R3 is from 20% to 50% of the bottle diameter, the difference between R1—R1 and R3—R3 may range from 65% of the bottle diameter at the upper end (where R1 is 0.85 R and R3 is 0.20 R), to 20% of the bottle diameter at the lower end (where R1 is 0.70 R and R3 is 0.50 R). In such cases, the radial arc defined by R1 may extend in range from 20% to 65% further than the radial arc defined by R3.

Figure 20:
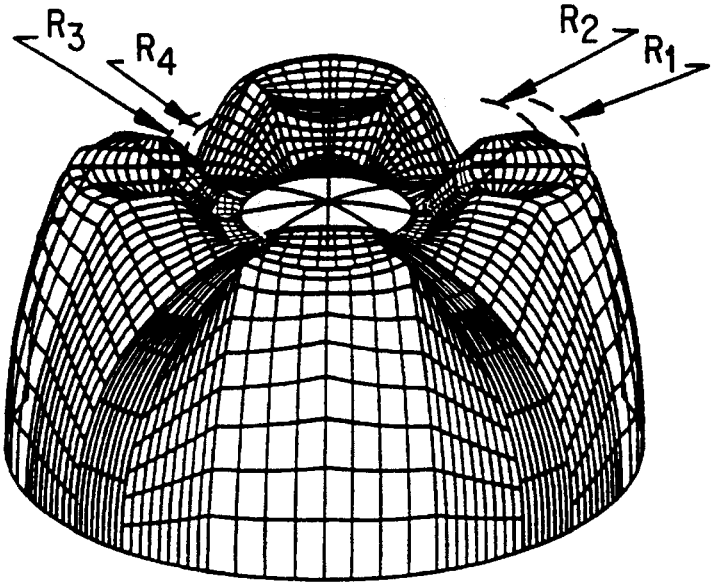
FIG. 20 is a perspective view of the bottom portion of an alternate embodiment of the present invention.
Figure 19:
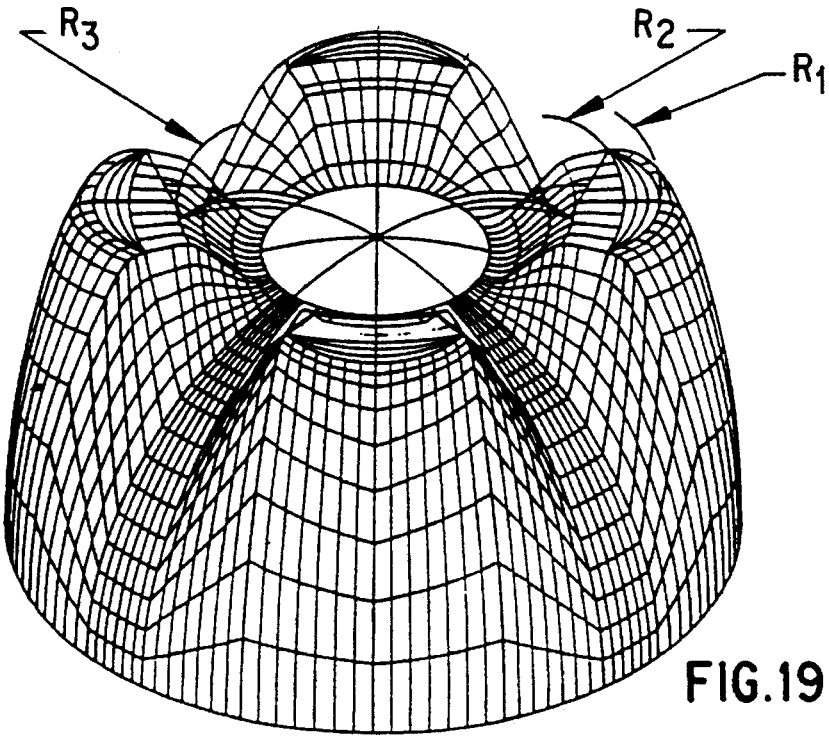
FIG. 19 is a perspective view of the bottom portion an embodiment of the present invention.

In FIGS. 19 and 20 are shown perspective views of bottom portions of embodiments of the present invention. The structural lines shown in those figures represent the distribution and orientation of the plastic material in the bottom portions of the container. It will be appreciated that where the torsional lines are spaced in close proximity to each other, material thickness will generally be greater than in those areas where the torsional lines are further apart. Similarly, where the lines are further apart, there is a greater stretching and orientation of the plastics material. In both FIGS. 19 and 20, the edge portions of the feet on which the bottle rests to include a non-uniform bottom circumferential footprint. Because the shape of the feet also affects the distribution and strength of the plastic material of the container, the non-uniform foot edges results in a better balance of the surface area tensions between the foot edges and the lower portions of the container sidewalls with the bending moment of the plastic material. It has been found that by making this modification in the bottom configuration the advantages of both proper biaxial orientation and maximal stretch are maximized.

As compared to known, prior art plastic bottles that have contact surfaces which are generally substantially uniform with respect to the container circumference, the configuration of the contact surfaces of containers of the present invention provide certain advantages in manufacturing. Specifically, the total amount of plastic material required to be stretched in the radial direction is less than would be required if the entire outer foot edge were of a uniform radial dimension. Typically, the bottles of the present invention may be fabricate with 1 to 4 percent less resin (depending on the container size) than comparable bottles having uniform circumferential footprints. Thus, not only is less material required, but because the plastic does not require stretching to the same extent that a container with a uniform radius does, there is a decrease in dwell time in the mold and the overall process window is enlarged, due specifically to the decreased dwell time. Finally, the non-uniform radius surface, as it extends upward on the container base creates an inward force which balances the bending moment in the gate area. This, in turn, limits or minimizes the deflection/movement in the gate area and thus prevents stress cracking. Additionally, because the bending moments of the non-uniform surface areas are better balanced with the bending moment of the gate area, the dome height of the central region may be lowered, thus further minimizing the potential for stress cracking.

Although the invention has been described in detail with reference to preferred embodiments and specific examples, it is understood that variations and modifications may exist and are within the scope and spirit of the invention as defined and generally set forth in the claims which follow.

Having described the invention, what is claimed is:

1. A blow-molded container having a body comprising a neck, a generally cylindrical sidewall and a bottom, said sidewall defining the container diameter, said bottom comprising:

a central region, including a radius center point, said radius center point and said sidewall defining a radius;

a plurality of circumferentially spaced hollow legs having an outer side and an inner side, the outer side extending downwardly from the said sidewall and the inner side extending downwardly from said central region;

a plurality of ribs extending downwardly from said sidewall and converging in said central region, said ribs separating said legs; and a plurality of feet positioned at the end of said legs, said feet extending below said central region, each foot positioned between two of said plurality of ribs, said feet comprising a horizontal contact surface, said contact surface being defined by an inner foot edge having a fixed radius and an outer foot edge having a variable radius, said outer foot edge including a pair of outer far corner foot edges and a far middle foot edge wherein said far middle foot edge extends radially approximately 5 to 50% further than said outer far corner foot edges.

2. The container of claim 1 wherein said inner foot edge is from 25 to 50% of the radius.

3. The container of claim 1 wherein said outer far corner foot edges are from 35 to 65% of the radius.

4. The container of claim 1 wherein said far middle foot edge is from 70 to 85% of the radius.

5. The container of claim 1 wherein said inner foot edge is from 25 to 50% of the radius and said far middle foot edges are from 70 to 85% of the radius.

6. The container of claim 1 wherein said inner foot edge is from 25 to 50% of the radius and said outer far corner foot edges are from 35 to 65% of the radius.

7. The container of claim 1 wherein said inner foot edge is from 25 to 50% of the radius, said outer far corner foot edges are from 35 to 65% of the radius and said far middle foot edge is from 70 to 85% of the radius.

8. The container of claim 1 formed from a preform of polyethylene terephthalate.

9. A blow-molded container having a body comprising a neck, a generally cylindrical sidewall and a bottom, said sidewall defining a container diameter, said bottom comprising:

a central region;

a plurality of circumferentially spaced hollow legs having an outer side and an inner side, the outer side extending downwardly from the said sidewall and the inner side extending downwardly from said central region;

a plurality of ribs extending downwardly from said sidewall and converging in said central region, said ribs separating said legs; and a plurality of feet positioned at the end of said legs, said feet extending below said central region, each foot positioned between two of said plurality of ribs, said feet comprising a horizontal contact surface, said contact surface being defined by an inner foot edge having a variable radius and an outer foot edge having a variable radius, said inner foot edge including a pair of inner near corner foot edges and an inner near middle foot edge, said outer foot edge including a pair of outer far corner foot edges and a far middle foot edge wherein said far middle foot edge extends radially approximately 5 to 50% further than said outer far corner foot edges.

10. The container of claim 9 wherein of said inner foot edge is from 15 to 50% of the radius.

11. The container of claim 9 wherein said outer far corner foot edges are from 40 to 60% of the radius.

12. The container of claim 9 wherein said far middle foot edge is from 70 to 85% of the radius.

13. The container of claim 9 wherein said inner foot edge is from 15 to 50% of the radius and said outer far corner foot edges are from 40 to 60% of the radius.

14. The container of claim 9 wherein said inner foot edge is from 15 to 50% of the radius and said far middle foot edge is from 70 to 85% of the radius.

15. The container of claim 9 wherein said inner foot edge is from 15 to 50% of the radius, said outer far corner foot edges are from to 60% of the radius and said far middle foot edge is from 70 to 85% of the radius.

16. The container of claim 9 formed from a preform of polyethylene terpthalate.

* * * * *